US007119780B2

(12) United States Patent
Saishu et al.

(10) Patent No.: US 7,119,780 B2
(45) **Date of Patent: *Oct. 10, 2006**

(54) LIQUID CRYSTAL DISPLAY AND DRIVING METHOD OF THE SAME

(75) Inventors: Tatsuo Saishu, Tokyo (JP); Hajime Yamaguchi, Yokohama (JP); Rieko Fukushima, Yokohama (JP); Rei Hasegawa, Yokohama (JP); Kohki Takatoh, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/982,889

(22) Filed: Nov. 8, 2004

(65) Prior Publication Data

US 2005/0083288 A1 Apr. 21, 2005

Related U.S. Application Data

(62) Division of application No. 09/942,743, filed on Aug. 31, 2001, now Pat. No. 6,961,043.

(30) Foreign Application Priority Data

Sep. 29, 2000 (JP) ..... 2000-301381

(51) Int. Cl.
*G09G 3/36* (2006.01)

(52) U.S. Cl. ..... 345/96; 345/97; 345/209

(58) Field of Classification Search ..... 345/87–103, 345/208–210; 349/133
See application file for complete search history.

(56) References Cited

U.S. PATENT DOCUMENTS 5,561,441 A 10/1996 Hamano
5,838,293 A * 11/1998 Kondoh ..... 345/97
5,920,301 A 7/1999 Sakamoto et al.

(Continued)

FOREIGN PATENT DOCUMENTS

JP 08-095001 4/1996

(Continued)

OTHER PUBLICATIONS

Yasufumi Asao, et al., "Novel Ferroelectric Liquid Crystal Mode for Active Matrix Liquid Crystal Display Using Cholesteric-Chiral Smectic C Phase Transition Material", Jpn. J. Appl. Phys. vol. 38, Part 1, No. 10, Oct. 1999, pp. 5977-5983.

(Continued)

*Primary Examiner*—Lun-yi Lao
(74) *Attorney, Agent, or Firm*—Oblon, Spivak, McClelland, Maier & Neustadt, P.C.

(57) ABSTRACT

A display includes a ferroelectric liquid crystal material having an asymmetric polarity response property, a section which applies an image signal to a pixel of the material for every two fields forming one frame, and a controller which reverses the polarity of the signal in one frame period. Particularly, the controller is configured that the polarity of the signal is reversed in a selected one of first and second manners, the first manner initiating a signal amplitude change from a polarity in which a larger response of the material is obtainable, the second manner initiating a signal amplitude change from a polarity in which a smaller response of the material is obtainable, and the selected manner being smaller in the total of brightness deviation generated in a frame immediately after the change for each of predetermined brightness transitions.

3 Claims, 5 Drawing Sheets

U.S. PATENT DOCUMENTS

| | | | |
|---|---|---|---|
| 6,172,662 | B1 | 1/2001 | Itoh et al. |
| 6,496,170 | B1 | 12/2002 | Yoshida et al. |
| 6,577,289 | B1 | 6/2003 | Asao et al. |
| 6,809,717 | B1 | 10/2004 | Asao et al. |

FOREIGN PATENT DOCUMENTS

| | | |
|---|---|---|
| JP | 2000-338464 | 12/2000 |
| JP | 2000-10076 | 1/2001 |
| KR | 1998-080210 | 11/1998 |

OTHER PUBLICATIONS

Jürg Fünfschilling, et al., "Physics and Electronic Model of Deformed Helix Ferroelectric Liquid Crystal Displays", Jp. J. Appl. Phys. vol. 33, Part 1, No. 9A, Sep. 1994, pp. 4950-4959.

A.G.H. Verhulst, et al., "A Wide Viewing Angle Video Display Based on Deformed Helix Ferroelectric LC and a Diode Active Matrix", Conference Record of the International Display Research Conference (IDRC '94), pp. 377-380.

* cited by examiner (a)

| | | SUCCEEDING BRIGHTNESS LEVEL | | | | |
|---|---|---|---|---|---|---|
| | | 0 | 16 | 32 | 48 | 64 |
| PRECEDING BRIGHTNESS LEVEL | 0 | – | +1.5 | +2 | +1.5 | +1 |
| | 16 | 0 | – | 0 | 0 | 0 |
| | 32 | 0 | 0 | – | 0 | 0 |
| | 48 | 0 | 0 | 0 | – | 0 |
| | 64 | 0 | 0 | 0 | 0 | – |

(b)

| | | SUCCEEDING BRIGHTNESS LEVEL | | | | |
|---|---|---|---|---|---|---|
| | | 0 | 16 | 32 | 48 | 64 |
| PRECEDING BRIGHTNESS LEVEL | 0 | – | -0.7 | -1 | -0.5 | -0.3 |
| | 16 | 0 | – | 0 | 0 | 0 |
| | 32 | +2 | 0 | – | 0 | 0 |
| | 48 | +8 | +4 | +1 | – | 0 |
| | 64 | +14 | +7 | +2 | +1 | – |

(c)

| | | SUCCEEDING BRIGHTNESS LEVEL | | | | |
|---|---|---|---|---|---|---|
| | | 0 | 16 | 32 | 48 | 64 |
| PRECEDING BRIGHTNESS LEVEL | 0 | – | -0.4 | -0.5 | -0.3 | -0.2 |
| | 16 | 0 | – | 0 | 0 | 0 |
| | 32 | 0 | 0 | – | 0 | 0 |
| | 48 | 0 | 0 | 0 | – | 0 |
| | 64 | 0 | 0 | 0 | 0 | – |

LIQUID CRYSTAL DISPLAY AND DRIVING METHOD OF THE SAME

CROSS-REFERENCE TO RELATED APPLICATIONS

This application is a divisional of U.S. application Ser. No. 09/942,743 filed Aug. 31, 2001 now U.S. Pat. No. 6,961,043 and is based upon and claims the benefit of priority from the prior Japanese Patent Application No. 2000-301381, filed Sep. 29, 2000, the entire contents of each of which are incorporated herein by reference.

BACKGROUND OF THE INVENTION

1. Field of the Invention

The present invention relates to a liquid crystal display including a ferroelectric liquid crystal material which is held between a pair of electrode substrates and whose optical response is asymmetric with respect to the polarity of a voltage applied from the electrode substrates, and a driving method for the display.

2. Description of the Related Art

A conventional liquid crystal display is of a holding type which continues to hold an image of a previous frame until a new image is written. The display has a problem that the phenomenon of blur occurs during display of a moving image, unlike an impulse type display such as a CRT which illuminates only for an afterglow time of a fluorescent material in each frame. In a case where one follows a moving object whose position changes between the images of successive frames, one observes the object as if it moves on the display while the image of the preceding frame is continuously displayed. The blur phenomenon is recognized as a result that the eyes tend to trace the moving object by finely sampling observable information so that the position of the object can be interpolated between the images of the preceding and succeeding frames.

In order to solve the problem, and obtain a sufficient display facility for the moving image in the liquid crystal display, it is preferable that high-speed response liquid crystals such as OCB (optically compensated bend) mode nematic liquid crystals and ferroelectric liquid crystals are used to provide an image display period and a blank display period in one frame. Concrete examples of such a preferable system have been proposed. In one known system, a backlight is momentarily lit each time a liquid crystal response is completed with respect to writing of the entire image for one frame. Moreover, a field alternation (field inversion) driving form (Jpn. Pat. Appln. KOKAI Publication No. 10076/2000) is also known, in which one frame is divided into first and second fields for the asymmetric polarity response property of the liquid crystal, a voltage of one polarity is applied in the first field to set the liquid crystal into a transmission state where transmission of light is controllable in an analog manner, and a voltage of the opposite polarity is applied in the second field to set the liquid crystal into a non-transmission state where light is hardly transmitted.

A monostable ferroelectric liquid crystal is known as the latter high-speed response liquid crystal having the asymmetric polarity response property. Mono-stability is obtained by polymer network introduced into a liquid crystal cell, or by an initial alignment treatment in which a slow-cooling process is carried out under application of a Direct Current voltage. Additionally, the asymmetric optical response can be obtainable even in a ferroelectric liquid crystal whose polarization property is symmetric, by means of polarization plates arranged properly. However, this liquid crystal is not suitable for the field alternation driving form since the DC voltage is applied to the liquid crystal cell on time average.

If the driving operation of writing and holding voltages via TFT devices or the like is repeated for each frame to drive pixels of the ferroelectric liquid crystal generally having the symmetric response property, a voltage drop may occur in each pixel during a holding period by dielectric relaxation since a response time of the liquid crystal is usually longer than a writing time. This pixel voltage drop lowers effectiveness of the written voltage, and this causes a problem that brightness and contrast ratio cannot be sufficient for the written voltage. Moreover, in a symmetric polarity alternation driving mode where the polarity of the voltage applied to the crystal is reversed for each frame so as to be positive or negative evenly, a "step response" phenomenon occurs after a certain frame in which the amplitude of the signal voltage is changed. In the phenomenon, the pixel is repeatedly switched between bright and dark states over several frames and finally set into a specified light transmittance (Verhulst et al.: IDRC'94 digest, 377 (1994)). This "step response" phenomenon is caused by a different factor from the blur phenomenon of the holding type display, but the moving object trailing an afterimage may be observed as if the blur phenomenon has occurred.

As a solution to the "step response" phenomenon, there is a technique of erasing or canceling the preset charge by performing a reset driving operation in which a constant voltage is applied before the writing of each frame. Conventionally, various methods and circuitries are proposed for the reset driving operation.

On the other hand, in a liquid crystal display having the asymmetric polarity response property, one frame is divided into two fields. For example, the display is driven in an alternating polarity driving mode where an image is written with a voltage of the positive polarity in the preceding field, and the image is erased with a voltage of the negative polarity in the succeeding field. In this case, the positive polarity is determined as a polarity in which the amount of change in the light transmittance is larger with respect to the voltage applied to the liquid crystal cell (i.e., the polarity in which the (ferroelectric) polarization of the liquid crystal cell is responsive or has a larger response). The negative polarity is determined as a polarity in which the amount of change in the light transmittance is smaller with respect to the voltage applied to the liquid crystal cell (i.e., the polarity in which the (ferroelectric) polarization of the liquid crystal cell is not responsive or has a smaller response). Additionally, when a DC voltage component remains in the liquid crystal cell, image sticking occurs due to uneven distribution of impurity ions caused by the DC voltage component. Therefore, it is general that the liquid crystal cell is driven with an AC voltage whose driving waveform has substantially the same amplitude in the positive and negative polarities so that no DC voltage component is applied. That is, the liquid crystal display having the asymmetric polarity response property can be driven by the voltage of substantially the same driving waveform except that a horizontal scanning frequency is double the frequency of the liquid crystal display having the symmetric polarity response.

However, in a case where the liquid crystal display with the asymmetric polarity response property is driven with the AC voltage whose driving waveform has substantially the same amplitude in the positive and negative polarities, the light transmittance increases in one or several frames after a certain frame in which the amplitude of the signal voltage is changed. When the amplitude is changed initially in the polarity of a larger response, the light transmittance increases at the time of rising. When the amplitude is changed initially in the polarity for a smaller response, the light transmittance increases at the time of falling. For example, when an available range of the light transmittance is divided into 64 brightness levels, deviation of at least one brightness level can be easily observed as the afterimage. This problem can be solved by the known reset driving operation for the liquid crystal display having the symmetric polarity response property. However, since one frame is divided into two fields, the writing time is regulated to half the normal writing time. Therefore, if a reset time is further disposed, writing deficiency is caused. Moreover, a time margin for resetting can be obtained by driving the scanning lines in units of two such that each scanning line pair is erased during the writing of other scanning lines. However, this method requires a complicated array structure and a reduced aperture ratio. If erasing is incomplete, non-uniform DC voltage components remain in the pixels. Although the asymmetric polarity response type liquid crystal display is easily operable as an impulse type display which displays a moving image at high speed, there remains the problem that the moving image is impaired due to an afterimage.

BRIEF SUMMARY OF THE INVENTION

According to a first aspect of the present invention, there is provided a liquid crystal display which comprises: a ferroelectric liquid crystal material which is held between a pair of electrode substrates and whose optical response is asymmetric with respect to the polarity of a voltage applied thereto; a signal applying section which applies an image signal to a pixel of the liquid crystal material for every two fields forming one frame; and a polarity controller which reverses the polarity of the image signal in one frame period, the polarity controller being configured such that the polarity of the image signal is reversed in a selected one of first and second polarity control manners, the first polarity control manner initiating an amplitude change of the image signal from a polarity in which a larger response of the liquid crystal material is obtainable, the second polarity control manner initiating an amplitude change of the image signal from a polarity in which a smaller response of the liquid crystal material is obtainable, and the selected polarity control manner being smaller in the total of brightness deviation generated in a frame immediately after the amplitude change for each of predetermined brightness transitions.

According to a second aspect of the present invention, there is provided a liquid crystal display which comprises: a ferroelectric liquid crystal material which is held between a pair of electrode substrates and whose optical response is asymmetric with respect to the polarity of a voltage applied thereto; a signal applying section which applies an image signal to a pixel of the liquid crystal material for every three or more fields forming one frame; and a polarity controller which reverses the polarity of the image signal in one frame period, the polarity controller being configured to apply the image signal of a first polarity for each field in a first one of two successive periods obtained by dividing the frame period, and to apply the image signal of a second polarity opposite to the first polarity and of fixed amplitudes for each subsequent field in a second one of the two successive periods.

According to a third aspect of the present invention, there is provided a driving method for a liquid crystal display having a ferroelectric liquid crystal material which is held between a pair of electrode substrates and whose optical response is asymmetric with respect to the polarity of a voltage applied thereto, which method comprises: application of an image signal to a pixel of the liquid crystal material for every two fields forming one frame; and polarity control to reverse the polarity of the image signal in one frame period, the polarity of the image signal being reversed in a selected one of first and second polarity control manners, the first polarity control manner initiating an amplitude change of the image signal from a polarity in which a larger response of the liquid crystal material is obtainable, the second polarity control manner initiating an amplitude change of the image signal from a polarity in which a smaller response of the liquid crystal material is obtainable, and the selected polarity control manner being smaller in the total of brightness deviation obtained in a frame immediately after the amplitude change for each of predetermined brightness transitions.

According to a fourth aspect of the present invention, there is provided a driving method for a liquid crystal display having a ferroelectric liquid crystal material which is held between a pair of electrode substrates and whose optical response is asymmetric with respect to the polarity of a voltage applied thereto, which method comprises; application of an image signal to a pixel of the liquid crystal material for every three or more fields forming one frame; and polarity control to reverse the polarity of the image signal in one frame period, the image signal of a first polarity being applied for each field in a first one of two successive periods obtained by dividing the frame period, and the image signal of a second polarity opposite to the first polarity and of fixed amplitudes being applied for each subsequent field in a second one of the two successive periods.

In the aforementioned liquid crystal display and driving method for the display, the amplitude change is initiated from a polarity that is selected from polarities in which larger and smaller responses of the liquid crystal are respectively obtainable and that is smaller in the total of brightness deviation generated in the frame immediately after the amplitude change of the image signal for each of predetermined brightness transitions. Alternatively, the image signal of a first polarity is applied for each field in a first one of two successive periods obtained by dividing the frame period, and the image signal of fixed amplitudes for each field and of a second polarity opposite to the first polarity is applied for each subsequent field in a second one of the two successive periods. In either case, since the polarity of the applied voltage is adapted for the asymmetric optical response of the ferroelectric liquid crystal material, occurrence of an afterimage can be reduced. Accordingly, the contrast and aperture ratio can be improved without requiring a complicated array structure.

DETAILED DESCRIPTION OF THE INVENTION

Figure 1:
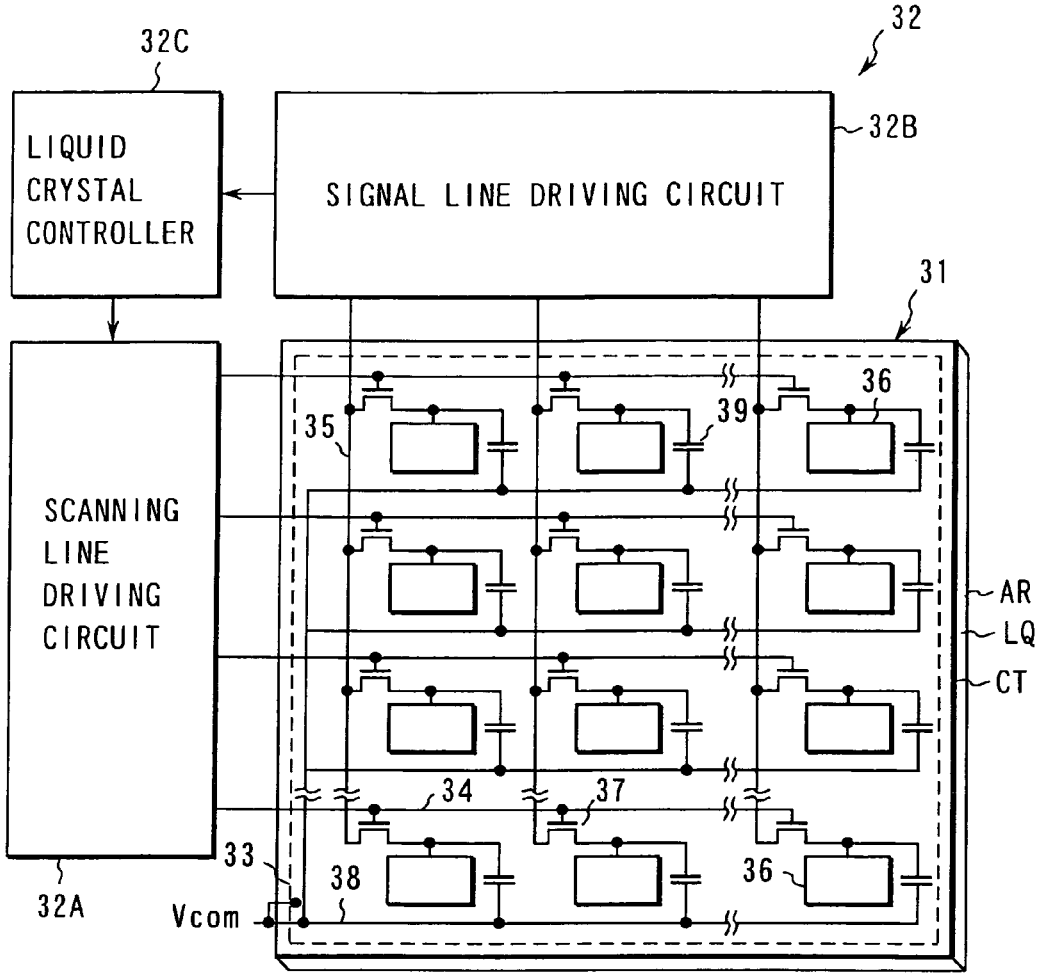
FIG. 1 is a diagram showing a circuit configuration of a liquid crystal display according to a first embodiment of the present invention.

A liquid crystal display according to a first embodiment of the present invention will be described hereinafter with reference to the accompanying drawings. As shown in FIG. 1, the liquid crystal display includes a liquid crystal panel 31 for displaying an image, and a display control circuit 32 for controlling a display operation of the liquid crystal panel 31. The liquid crystal panel 31 includes an array substrate AR, counter substrate CT, and liquid crystal cell LQ held between the substrates AR and CT. The counter substrate CT includes a counter electrode 33 set at a common potential Vcom. The array substrate AR includes a plurality of scanning lines 34, a plurality of signal lines 35 intersecting the scanning lines 34 and insulated from one another, a plurality of pixel electrodes 36 facing the counter electrode 33 in pixel regions partitioned by the scanning and signal lines, and a plurality of thin-film transistor (TFT) devices 37 formed near intersections of the scanning and signal lines as switching elements. Each TFT device 37 has a gate connected to a corresponding one of the scanning lines 34, a drain connected to a corresponding one of the signal lines 35, and a source connected to a corresponding one of the pixel electrodes 36, and applies an image signal from the corresponding signal line 35 to the corresponding pixel electrode 36 in response to a gate pulse from the corresponding scanning line 34. Moreover, each pixel electrode 36 is disposed in parallel with the scanning lines 34, and capacitively coupled with a storage capacitance line 38 of the common potential Vcom so as to form a storage capacitance 39. The display control circuit 32 includes a scanning line driving circuit 32A for supplying a gate pulse to the scanning lines 34 in different horizontal scanning periods, a signal line driving circuit 32B for supplying image signals to the signal lines 35 in each horizontal scanning period, and a liquid crystal controller 32C for controlling the scanning line driving circuit 32A and signal line driving circuit 32B. Concretely, the scanning line driving circuit 32A and signal line driving circuit 32B are associated such that the image signals are applied to pixels of the liquid crystal panel 31 for each frame. The liquid crystal controller 32C controls the scanning line driving circuit 32A and signal line driving circuit 32B to reverse the polarity of the image signal in one frame period. Here, the liquid crystal controller 32C is configured such that an amplitude change of the image signal is initiated from a polarity that is selected from polarities in which larger and smaller responses of the liquid crystal are respectively obtainable and that is smaller in the total of brightness deviation generated in the frame immediately after the amplitude change for each of predetermined brightness transitions.

Figure 2:
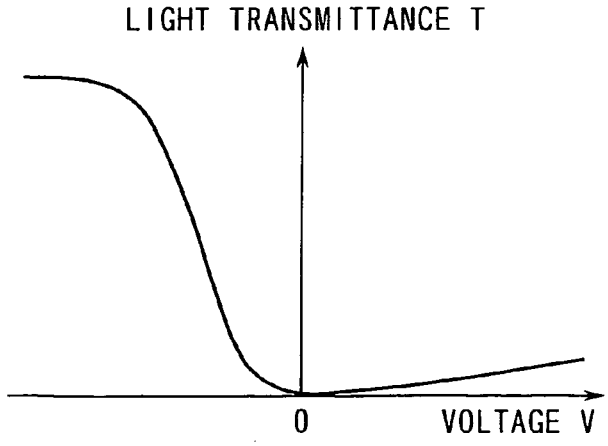
FIG. 2 is a graph showing a voltage-light transmittance characteristic of a liquid crystal cell shown in FIG. 1.
Figure 3:
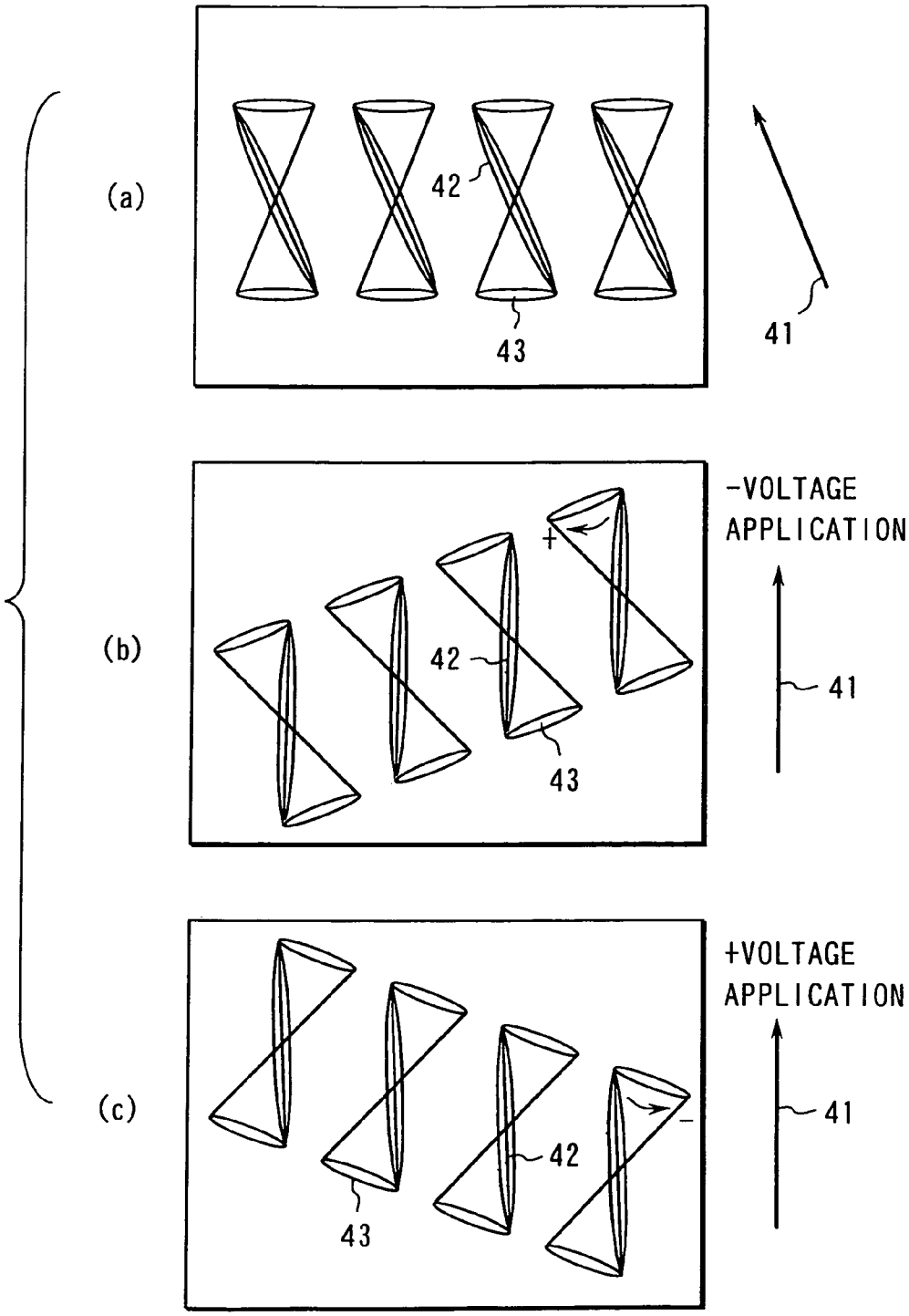
FIG. 3 is an explanatory view of alignment states in the liquid crystal cell shown in FIG. 1.

The liquid crystal cell LQ has a structure in which a ferroelectric liquid crystal having phase sequence of Iso-Ch-SmC* is monostable, and has a voltage-light transmittance characteristic as shown in FIG. 2. Additionally, unless otherwise specified hereinafter, a pair of polarizing plates are disposed in a cross-Nicol manner with respect to the liquid crystal cell LQ having the voltage-light transmittance characteristic shown in FIG. 2, thereby setting a normally black mode in which a black display is maintained in a state where no voltage is applied. FIG. 3 shows alignment states of the liquid crystal cell LQ observed from above the liquid crystal panel 31. A longer axis of a liquid crystal molecule 42 is parallel to a uniaxial alignment treatment direction 41 (e.g., rubbing direction) when no voltage is applied. On the other hand, the liquid crystal molecule 42 rotates on a conical surface 43 in accordance with the applied voltage when the voltage is of one polarity. The molecule stays in the uniaxial alignment treatment direction 41 when the voltage is of the opposite polarity. Here, assuming that a product And of the anisotropic refractive index $\Delta n$ in the liquid crystal cell LQ and the thickness d of the liquid crystal cell LQ is ½ a wavelength, a maximum change in brightness is obtained when an in-plane rotation angle of the liquid crystal molecule 42 is 45° (i.e., a position after the molecule half turns on the conical surface). In an alignment formation process, the liquid crystal panel 31 is heated to the temperature of a Ch phase of the ferroelectric liquid crystal, and then cooled to the temperature of an SmC* phase in a condition that a DC voltage of +1 to +5 V or −1 to −5 V is applied between the pixel electrode 36 and the counter electrode CT. In this case, a rotation direction and response polarity of the liquid crystal molecule 42 depend on the polarity of the applied voltage as shown in (b) and (c) of FIG. 3. Additionally, In the alignment formation process, the polarity of the applied voltage may be reversed for each row and/or column of the pixel electrodes. Moreover, a polymer stabilized ferroelectric liquid crystal may be used for the liquid crystal cell LQ. This polymer stabilized ferroelectric liquid crystal is obtained by applying an ultraviolet ray having a wavelength of 365 nm and illuminance of 2 $mW/cm^2$ to a mixture of a liquid crystal methacrylate photocurable material and ferroelectric liquid crystal for 30 seconds at the SmC phase temperature with the above-mentioned DC voltage or at the temperature of an SmA phase, and has an asymmetric polarity response property similar to the voltage-light transmittance characteristic shown in FIG. 2.

An operation of the liquid crystal display will be described. In the field alternation driving form, image signals of the same polarity are written into all the pixel electrodes 36 during the same field. Thus, cross talk easily occurs. In a signal line alternation driving form, the polarity is reversed for each signal line 35 to reduce a phenomenon in which a pixel potential shifts toward the opposite polarity due to capacitive coupling with the adjacent signal lines 35. Further, in a scanning line alternation driving form, the polarity is reversed for each scanning line 34 to similarly reduce the influence of the capacitive coupling. Moreover, in a dot alternation driving form, the polarity is reversed for each scanning line 34 and for each signal line 35. Thus, cross talk can be considerably reduced.

The present invention is applicable to any one of the signal line, scanning line, and dot alternation driving forms. However, to improve the display quality, it is preferable that voltages of different polarities are applied in the alignment formation process such that two alignment states shown in (b) and (c) of FIG. 3 are respectively provided for the pixels assigned to one polarity and the pixels assigned to the opposite polarity to simultaneously operate in the black or white display mode during the same field.

Figure 4:
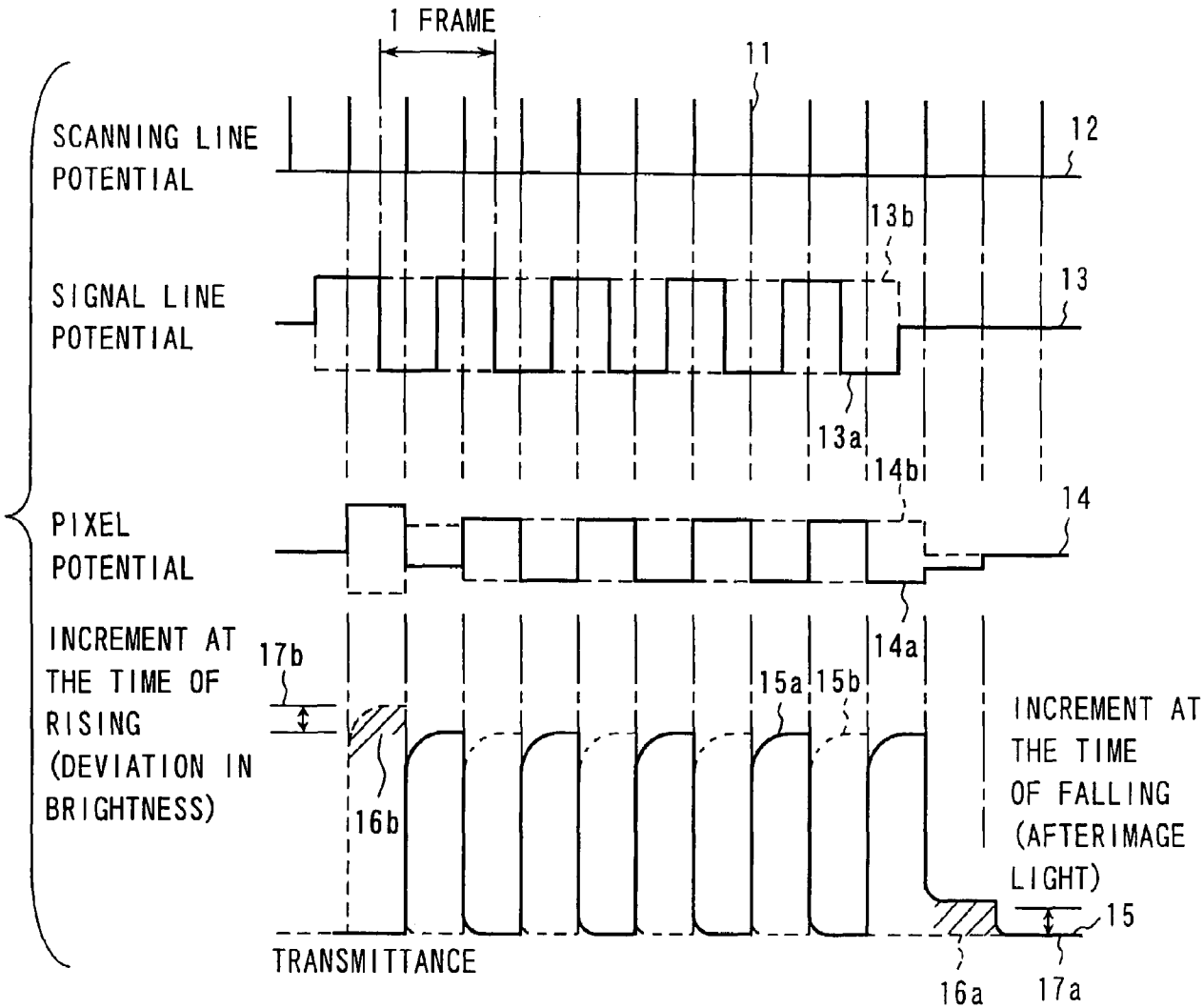
FIG. 4 is a waveform diagram showing driving and optical response waveforms of the liquid crystal display shown in FIG. 1.

FIG. 4 shows a potential waveform 12 of the scanning line 34, potential waveform 13 of the signal line 35, potential waveform 14 of the pixel electrode 36 and optical response (light transmittance) waveform 15 obtained in the liquid crystal panel 31 when the signal line driving circuit 32B operates in the aforementioned signal line alternation driving form. The symmetric polarity response liquid crystal is usually driven at 60 Hz (one frame=16.7 ms), while the asymmetric polarity response liquid crystal is driven at 120 Hz (one field=8.3 ms, one frame=two fields). Therefore, the liquid crystal controller 32C requires a field memory for storing data of image signals. In the potential waveform of each scanning line 34, gate pulses 11 are arranged at an interval of 8.3 ms, and a width of the gate pulse 11 is a value obtained by dividing 8.3 ms by a total number of scanning lines (e.g., 10.9 μs with 768 lines of XGA). Similarly to a conventional active matrix type liquid crystal display, only while the gate pulse 11 is applied to a gate terminal of the TFT device 37 of each pixel, the TFT device 37 is turned on, and the voltage of the signal line 35 is written in the pixel electrode 36. A charge of the pixel electrode 36 is held while the TFT device 37 is off. Additionally, the pixel voltage drops in the holding period by dielectric relaxation of the ferroelectric liquid crystal as described above. The amount of voltage drop increases with an increase of spontaneous polarization of the liquid crystal molecule 42, and decreases with an increase of the storage capacitance 39.

Figures 5, 6:
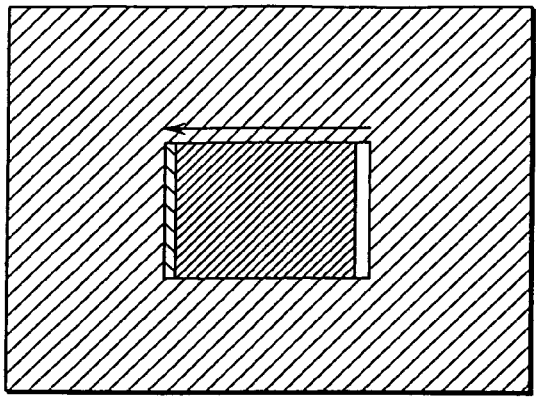
FIG. 5 is an explanatory view of an afterimage observed in the liquid crystal display shown in FIG. 1 when a large brightness deviation is generated upon transition of brightness.
FIG. 6 is a diagram showing a relation between the brightness deviation generated in the liquid crystal display shown in FIG. 1 and the combination of preceding and succeeding brightness levels.

Here, signal line potential waveforms 13*a* and 13*b*, pixel potential waveforms 14*a* and 14*b*, and optical response (light transmittance) waveforms 15*a* and 15*b* are respectively indicative of a case where the voltage is applied (i.e., the signal amplitude is changed) initially from the polarity in which a smaller response is obtainable in one frame, and of a case where the voltage is applied (i.e., the signal amplitude is changed) initially from the polarity in which a larger response is obtainable. The polarity for the smaller response corresponds to a positive polarity (right-side) in the voltage-light transmittance characteristic shown in FIG. 2, and the polarity for the larger response corresponds to a negative polarity (left-side) in the voltage-light transmittance property shown in FIG. 2. Even when the signal amplitude is changed initially from either polarity, the light transmittance becomes substantially higher in the first frame immediately after the amplitude change, as compared with a stable value of the light transmittance of the subsequent frames. When the polarity for the smaller response precedes, a brightness deviation 16*a* appears at the time of falling time. When the polarity for the larger response precedes, a brightness deviation 16*b* appears at the time of rising. A large brightness deviation is the cause of a blur or an afterimage in which the moving image trails. This afterimage is conspicuously recognized when a black or white moving image is displayed in a uniform gray background as shown in FIG. 5. Therefore, it is necessary to minimize the brightness deviation of the first frame immediately after the amplitude change to suppress the afterimage. For this purpose, measurement is required to evaluate which polarity should appropriately precede for the signal amplitude change.

(a) and (b) of FIG. 6 show collective results of the brightness deviation generated for transition among 64 brightness levels when the signal amplitude is changed from the polarity for the larger response and from the polarity for the smaller response in one frame, respectively. Values shown in (a) and (b) of FIG. 6 are a brightness level corresponding to a deviation of the brightness in the first frame from that in the second and subsequent frames. It is preferable to measure the deviation with respect to all the brightness levels for actual use, such as 64 and 256 brightness levels. Here, for ease of understanding, a measurement result is shown with respect to the minimum necessary four brightness levels among 64 brightness levels. According to the result, when the amplitude change is initiated from the larger response polarity, the brightness deviation is two levels at maximum, and a total value (i.e., a total absolute value of the brightness deviation) is six. On the other hand, when the amplitude change is initiated from the smaller response polarity, the deviation is 14 levels at maximum, and the total value is 41.5. Therefore, it is seen that the amplitude change from the larger response polarity is desirable, because the afterimage hardly occurs.

In general, the measurement results are compared with each other in this manner, and a smaller total value is preferably selected. In the measurement results shown in FIG. 6, measured values among omitted brightness levels are substantially equal to interpolated values. Therefore, even with measurement for all the 64 brightness levels (or 256 brightness levels) and comparison of the brightness deviation total values, a similar result is obtained, that is, the amplitude change from the larger response polarity is better. In the liquid crystal such as the monostable ferroelectric liquid crystal, it is particularly slow in the falling response that the liquid crystal molecule 42 returns from a rotated angle to an initial angle parallel to the rubbing direction upon writing of 0V. This considerably increases the brightness deviation at the time of falling. Thus, it is preferable to initiate the amplitude change from the polarity in which a larger response is obtainable upon application of a voltage. Conversely, in the liquid crystals having a quick falling property, the brightness deviation increases relatively at the time of rising. Therefore, it is preferable to initiate the amplitude change from the polarity in which almost no response is obtainable upon application of a voltage, so that afterimage can be eliminated form the displayed image. In an alternation driving form other than the field alternation driving form, a moving direction and voltage polarity of the liquid crystal molecule 42 are variably determined for each pixel as shown in (b) and (c) of FIG. 3. Therefore, a different one of the positive and negative polarities is determined for each pixel as the polarity of the voltage actually applied for the larger response. The present invention is applicable even in this case, and it is only required that one of the larger response and smaller response polarities suitable for initiation of the amplitude change is selected for each pixel by doing the aforementioned comparison. As a result, the polarities of voltages applied to the pixels in each field are arranged in the same manner as that for the usual alternation driving form.

In the liquid crystal display of the present embodiment, the signal line driving circuit 32 drives each signal line 35 such that the amplitude change of the voltage applied to a corresponding pixel is initiated from that one of the larger response and smaller response polarities in each frame period, which is selected according to a result of the aforementioned comparison. Consequently, an afterimage can be effectively prevented in the structure that the ferroelectric liquid crystal having the asymmetric polarity response property forms the liquid crystal cell LQ.

The liquid crystal display according to a second embodiment of the present invention will be described hereinafter with reference to the accompanying drawings. The liquid crystal display is similar to that of the first embodiment except the configuration of the display control circuit 32.

Therefore, parts similar to that of the first embodiment are denoted with the same reference numerals, and a description thereof is omitted.

In the liquid crystal display, the scanning line driving circuit 32A and signal line driving circuit 32B operate to apply image signals to the pixels of the liquid crystal panel 31 for every three or more fields forming one frame. The liquid crystal controller 32C controls these scanning line driving circuit 32A and signal line driving circuit 32B so that the polarity of each image signal is reversed in one frame period. Here, the liquid crystal controller 32C is configured to apply the image signal of a first polarity for each field in a first one of two successive periods obtained by dividing the frame period, and to apply the image signal of a second polarity opposite to the first polarity and of fixed amplitudes for each subsequent field in a second one of the two successive periods.

Figure 7:
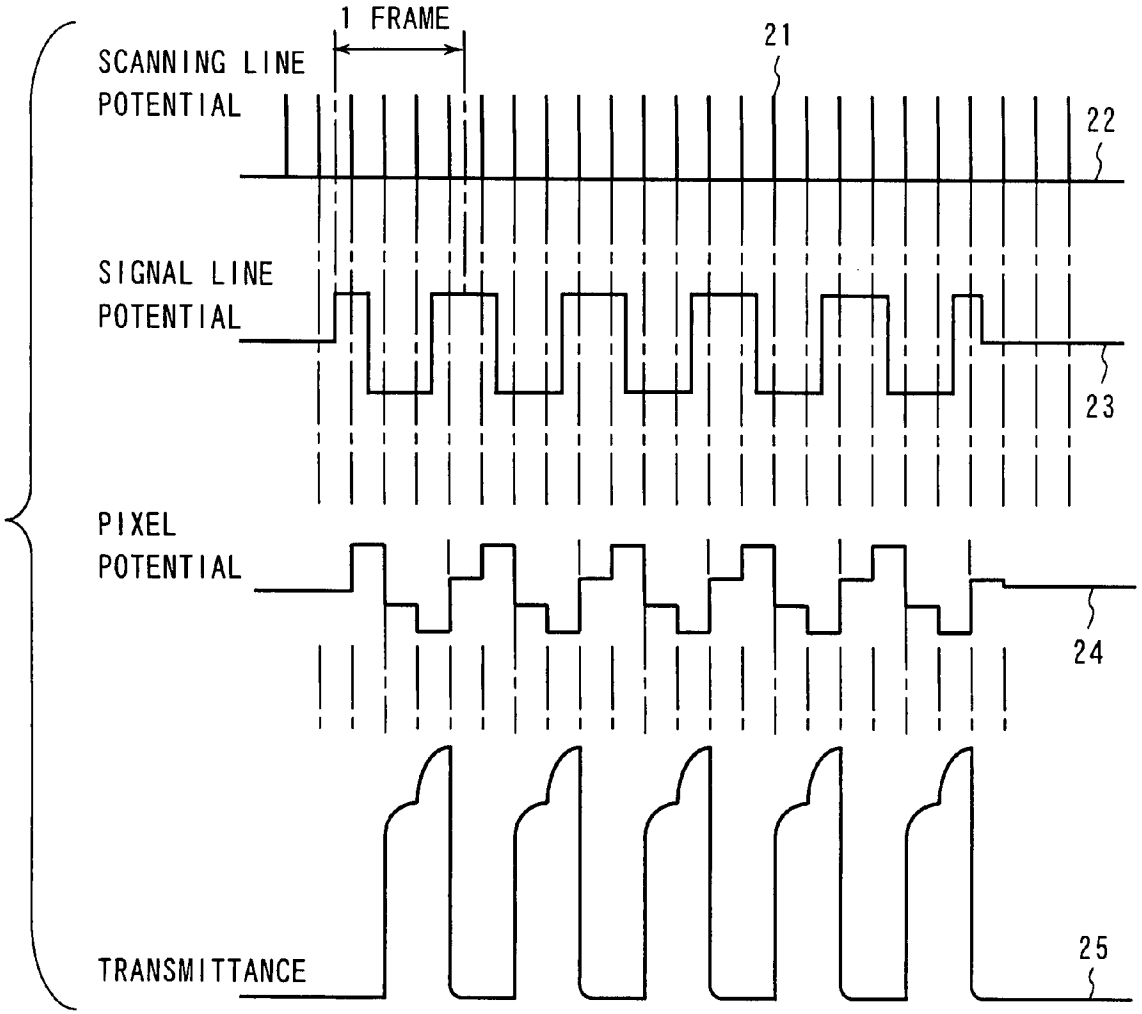
FIG. 7 is a waveform diagram showing driving and optical response waveforms of the liquid crystal display according to a second embodiment of the present invention.

The signal line driving circuit 32 is configured to operate in the signal line alternation driving form such that a potential waveform 22 of the scanning line 34, potential waveform 23 of the signal line 35, potential waveform 24 of the pixel electrode 36, and optical response (light transmittance) waveform 25 are obtained in the liquid crystal panel 31 as shown in FIG. 7. Here, the horizontal scanning frequency is double the frequency of the first embodiment. The signal with the same polarity is repeatedly written into each pixel electrode 36 twice in one frame. In the second writing for the smaller response property, the amplitude of the signal determined according to that for the next frame. Assume that V(n) denotes the signal amplitude for a certain pixel in the n-th frame, V(n+1) denotes the signal amplitude for the certain pixel in the $n+1^{st}$ frame, and the negative polarity is determined as a polarity for the larger response property of the certain pixel. Then, four writing voltages +V(n), −V(n), −V(n), and +V(n) are applied in the n-th frame, and four writing voltages +V(n+1), −V(n+1), −V(n+1), +V(n+1) are applied in the subsequent $n+1^{st}$ frame. In the two consecutive frames, the two positive writing fields (smaller response polarity) adjoin each other. The first one is of the signal for the n-th frame, and the second one is of the signal for the $n+1^{st}$ frame. These positive writing voltages for the small response property serve as pulses for resetting and preliminary writing, respectively, thus considerably decreasing the brightness deviation. Concretely, when the liquid crystal having the same property as that of the first embodiment is used, the falling brightness deviation property is represented by the values of a left lower triangular region (preceding brightness level>succeeding brightness level) shown in (a) of FIG. 6, and the rising brightness deviation property is represented by the values of a right upper triangular region (preceding brightness level<succeeding brightness level) shown in (b) of FIG. 6. Furthermore, in two consecutive writings with the same polarity, the brightness deviation occurs only in the first writing, and turns to zero in the second writing, and the value is therefore practically ½. Consequently, the result is obtained as shown in (c) of FIG. 6. The result reveals that the existing brightness deviation is fully regulated below one brightness level, and the afterimage is eliminated to a degree having no practical problems. Moreover, since the writing for the larger response property is repeated twice, improved transmittance is attainable as an incidental effect. A driving form of repeatedly writing the same polarity signal is known (Jpn. J. Appln. Phys. Vol. 33 (1994) 4950 to 4959, the entire contents of which are incorporated herein by reference). Even if a total period of the writing time is the same, the amount of optical response is larger in two-time writings than in one-time writing. Therefore, transmittance in the optical response waveform 25 is improved as shown in FIG. 7. Since the conventional writing order is changed to solve the problem without requiring any additional time margin for resetting, the same total writing time as that of the conventional art can be secured.

In the present embodiment, writing is repeated twice for each polarity (one frame=four fields), but the number of repetitive writings with the same polarity is not limited to two, and one frame may further be divided into a large number of fields and a large number of writings may be performed. In this case, in a plurality of writings for the smaller response property, the amplitude for several writings from the first one (i.e., the amplitude for the same frame) is determined such that the previous opposite polarity writing is cancelled, and the amplitude for several writings to the last one (i.e., the amplitude for the next frame) is determined as that of a preliminary writing for the next opposite polarity writing. As a result, a similar effect is obtained. When the voltage of the same polarity is written three times, six writing voltages +V(n), −V(n), −V(n), −V(n), +V(n), +V(n) may be applied in the n-th frame and six writing voltages +V(n+1), −V(n+1), −V(n+1), −V(n+1), +V(n+1), +V(n+1) may be applied in the subsequent $n+1^{st}$ frame, for example.

Moreover, a plurality of fields forming one frame may not have the same period of time.

Furthermore, even when one frame is divided into a plurality of fields different in length from one another, writing for the larger response property is performed once, and writing for the smaller response property is performed a plurality of times (the amplitude is changed as described above), a similar effect is obtained.

Only when a voltage for the smaller response polarity is written into the pixel of a non-voltage state or a smaller response polarity state, the pixel potential hardly drops in the holding period. Therefore, there is a possibility that the average value of the smaller response polarity pixel potential becomes higher than the average value of the larger response polarity pixel potential due to repetitive application of the writing voltage of the polarity for the smaller response property. In this case, a DC voltage component which remains according to the polarity asymmetry of the pixel potential is eliminated by a countermeasure of shortening the period of one or both of the two fields assigned to the writing for the smaller response property, so that image sticking due to uneven distribution of impurity ions can be prevented.

Additionally, in the liquid crystal display of the second embodiment, a sequence of the image signal sent out to the signal line differs from a conventional one, and therefore a frame memory for storing data of the image signal is required. However, since the field memory is already prepared for driving the aforementioned asymmetric polarity response liquid crystal at 120 Hz, an increase of the manufacturing cost is slight for the driving method according to the second embodiment. In a case where the alternation driving form other than the field inversion driving form is employed, a moving direction and voltage polarity of the liquid crystal molecule 42 are variably determined for each pixel as shown in (b) and (c) of FIG. 3. Therefore, a different one of the positive and negative polarities is determined for each pixel as the polarity of the voltage actually applied for the larger response. Even in this case, the present invention is applicable, and it is possible to employ a driving form of changing the amplitude of the voltage of consecutive writings only for the smaller response polarity of each pixel.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A liquid crystal display comprising:

a ferroelectric liquid crystal material configured to be held between a pair of electrode substrates and optical response thereof is asymmetric with respect to the polarity of a voltage applied;

a signal applying section configured to apply to a pixel of said liquid crystal material an image signal which is updated for each of three or more fields forming one frame; and a polarity controller configured to reverse the polarity of the image signal in one frame period, said polarity controller being configured to apply the image signal of a first polarity for each field in a first one of two successive periods obtained by dividing the frame period, and to apply the image signal of a second polarity opposite to the first polarity for each subsequent field in a second one of the two successive periods, wherein the image signal applied for the field other than the last field in the second one of the two successive periods has a fixed amplitude, and the image signal applied for the last field in the second one of the two successive periods has an amplitude that depends on the amplitude of the image signal for the next frame.

2. A liquid crystal display comprising:

a first substrate including a plurality of pixel electrodes arranged substantially in a matrix, a plurality of scanning lines disposed along rows of said pixel electrodes, a plurality of signal lines disposed along columns of said pixel electrodes, and a plurality of switching elements each of which is disposed near an intersection of corresponding scanning and signal lines and driven via the corresponding scanning line to apply the potential of the corresponding signal line to a corresponding pixel electrode;

a second substrate including a counter electrode facing said pixel electrodes;

a driving section configured to drive one of said scanning lines sequentially selected for each horizontal scanning period, and said signal lines during said each horizontal scanning period;

a liquid crystal cell including a ferroelectric liquid crystal material configured to be held between said first and second electrode substrates and optical response thereof is asymmetric with respect to the polarity of a voltage applied between said pixel and counter electrodes; and a liquid crystal controller configured to control said driving section to supply to each signal line an image signal which is updated for each of three or more fields forming one frame and to reverse the polarity of the image signal in one frame period, said liquid crystal controller being configured to apply the image signal of a first polarity for each field in a first one of two successive periods obtained by dividing the frame period, and to apply the image signal of a second polarity opposite to the first polarity and of a fixed amplitude for each subsequent field in a second one of the two successive periods, wherein the image signal applied for the fields other than the last field in the second one of the two successive periods has a fixed amplitude, and the image signal applied for the last field in the second one of the two successive periods has an amplitude that depends on the amplitude of the image signal for the next frame.

3. A driving method for a liquid crystal display having a ferroelectric liquid crystal material configured to be held between a pair of electrode substrates and optical response thereof is asymmetric with respect to the polarity of a voltage applied, comprising:

applying an image signal, which is updated for each of three or more fields forming one frame, to a pixel of said liquid crystal material; and reversing the polarity of the image signal in one frame period, said image signal of a first polarity being applied for each field in a first one of two successive periods obtained by dividing the frame period, and said image signal of a second polarity opposite to the first polarity being applied for each subsequent field in a second one of the two successive periods, wherein the image signal applied for the fields other than the last field in the second one of the two successive periods has a fixed amplitude, and the image signal applied for the last field in the second one of the two successive periods has an amplitude that depends on the amplitude of the image signal for the next frame.

* * * * *